US005826861A

United States Patent [19]

Indge et al.

[11] Patent Number: 5,826,861

[45] Date of Patent: Oct. 27, 1998

[54] GUARD RAIL SYSTEM FOR LOADING FLAT BED TRUCKS

[75] Inventors: Donald S. Indge, Belmont; William R. Straker, Acton, both of Mass.

[73] Assignee: W.R. Grace & Co.-Conn., New York, N.Y.

[21] Appl. No.: 787,501

[22] Filed: Jan. 21, 1997

[51] Int. Cl.[6] ..... E04H 17/00

[52] U.S. Cl. ..... 256/1; 256/59; 256/DIG. 2

[58] Field of Search ..... 256/13.1, 59, 65, 256/60, 67, 25, 26, DIG. 2, DIG. 6, 12.5, 24, 27, 1; 404/6, 9

[56] References Cited

U.S. PATENT DOCUMENTS

| | | | |
|---|---|---|---|
| 3,010,684 | 11/1961 | Phillips et al. | 256/12.5 X |
| 3,141,639 | 7/1964 | Klein | 256/24 X |
| 3,332,667 | 7/1967 | Armstrong | 256/24 X |
| 3,385,564 | 5/1968 | Persicke | 256/13.1 |
| 4,280,685 | 7/1981 | At. Angelo | 256/13.1 X |
| 4,909,483 | 3/1990 | Van Herpen | 256/59 |
| 5,356,119 | 10/1994 | Schock | 256/24 X |

FOREIGN PATENT DOCUMENTS

| | | | |
|---|---|---|---|
| 1430850 | 1/1966 | France | 256/25 |
| 2661932 | 11/1991 | France | 256/59 |
| 3420503 | 12/1984 | Germany | 256/13.1 |
| 1717697 | 3/1992 | U.S.S.R. | 256/13.1 |

*Primary Examiner*—Harry C. Kim
*Attorney, Agent, or Firm*—Craig K. Leon; William L. Baker

[57] ABSTRACT

An exemplary moveable guard rail system of the present invention, useful for preventing fork lift trucks from falling off flat bed trailers, comprises at least two guard rails connected sequentially to each other and to hinged supportive frame members. The guard rails can be moved between extended and retracted positions by hinged arm members which may be powered by hydraulic pistons. Preferably, gimbal bearing members are used for connecting the guard rail or rails to the hinged supportive frame members.

8 Claims, 4 Drawing Sheets

GUARD RAIL SYSTEM FOR LOADING FLAT BED TRUCKS

FIELD OF THE INVENTION

The present invention relates to a safety device for use in loading flat bed trucks, and more particularly to a moveable guard rail system for preventing fork lift devices from falling off a flat bed truck or railroad car during loading or unloading.

BACKGROUND OF THE INVENTION

Drivers of fork lift trucks and other loading vehicles are vulnerable to serious injury if they drive off the edge of a flat bed trailer or railroad car. While it may be feasible to install a restraining system, such as a raised bead or wall, at the edges of the truck or other flat bed vehicle surface, there are concommitant disadvantages quite apart from additional expense to the vehicle owner. One disadvantage is that the fork lift operator needs to rely on every truck trailer to have a safety restraint device compatible with the particular loading dock. Another is that a raised edge on the trailer may not be high enough for large-wheeled fork lift trucks. A fixed restraining system with a sufficiently high wall would restrict loading and off-loading at other sites, and may require disassembly to allow the fork lift truck or other loading device to be driven onto the flat bed trailer. A further disadvantage of a restraining device is that access to the sides of the trailer, for the purposes of fastening and covering the load prior to departure, may be restricted. In view of the foregoing disadvantages of the prior art, a novel guard rail system is needed for protecting fork lift trucks during the loading and unloading of flat bed trailers and the like.

SUMMARY OF THE INVENTION

In surmounting the disadvantages of the prior art, the present invention provides a novel moveable guard rail system for protecting fork lift trucks during loading and unloading of flat bed trailers. One advantage is that the moveable guard rail can be maneuvered to accommodate skewed positioning of a truck trailer which may not be aligned perpendicularly with a loading dock. Another advantage is that, where moveable guard rail systems of the invention are used on both sides of flat bed trailer, full protection can be provided along the entire length of the trailer even if it is parked off-center in the loading dock. Yet another advantage of the moveable guard rail system of the present invention is that it may be used with flat bed trailers of various heights.

An exemplary moveable guard rail system of the present invention comprises a moveable frame structure having at least one guard rail member, at least two hinged supportive frame members spaced apart from each other and connected, preferably by a gimbal bearing, to the at least one guard rail member, and at least two axis hinge mounts spaced apart from each other for hingedly mounting the at least two hinged supportive frame members to a base or floor. The moveable frame structure can be moved between a retracted position away from the trailer and an extended position where the guard rail is positioned adjacent to the trailer edge to prevent fork lift trucks from driving off the trailer. The exemplary guard rail system further comprises at least one arm assembly, and preferably a plurality of spaced-apart arm assemblies, connected to the moveable frame structure, and comprising means such as a hydraulic piston for moving the moveable frame structure between retracted and extended positions.

In another exemplary embodiment, at least one guard rail member is connected to at least one hinged supportive frame member by a gimbal bearing operative to permit at least partial rotational movement of the guard rail member with respect to the at least one hinged supportive frame member. More preferably, the gimbal bearing system permits sliding as well as rotational movement of the guard rail with respect to the hinged supportive frame member. In still further exemplary guard rail systems, at least two guard rail members are sequentially connected to each other by a connector. Further advantages and features of the invention are described hereinafter.

The invention therefore provides a sorely needed, yet efficient and convenient remedy for minimizing the risks of bodily injury and equipment damage during fork lift loading/unloading operations on flat bed trailers and railroad cars.

BRIEF DESCRIPTION OF THE DRAWINGS

The following detailed description of preferred embodiments of the present invention will be more readily comprehended in view of the appended drawings, wherein.

DETAILED DESCRIPTION OF PREFERRED EMBODIMENTS

Figure 1:
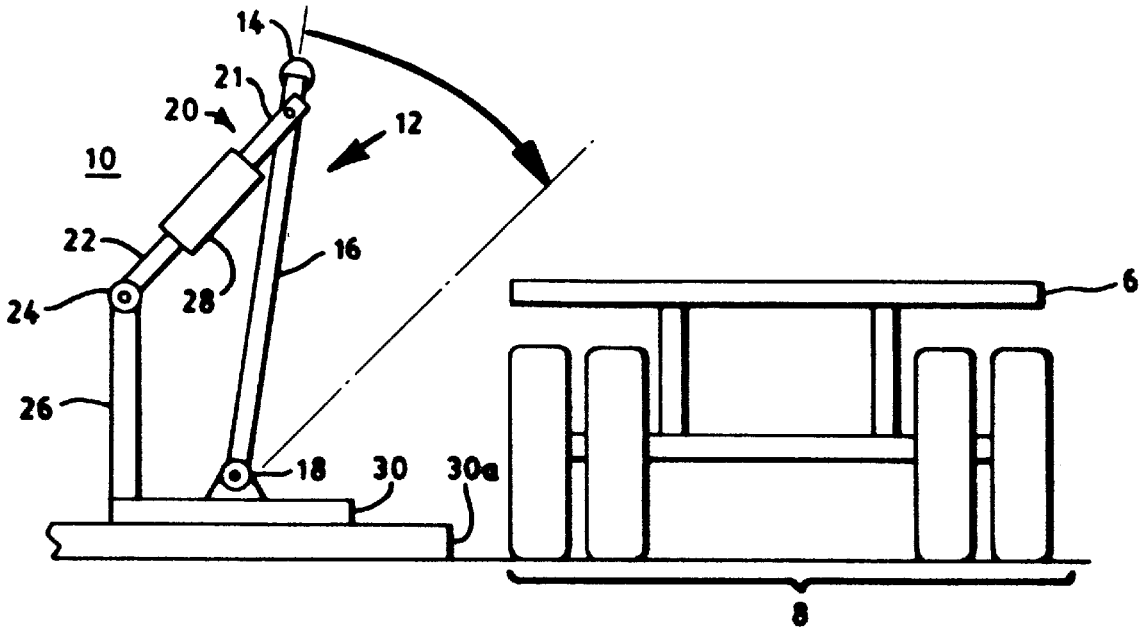
FIG. 1 is an end-view illustration of an exemplary moveable fork lift truck guard rail system of the present invention shown in a retracted position.
Figure 2:
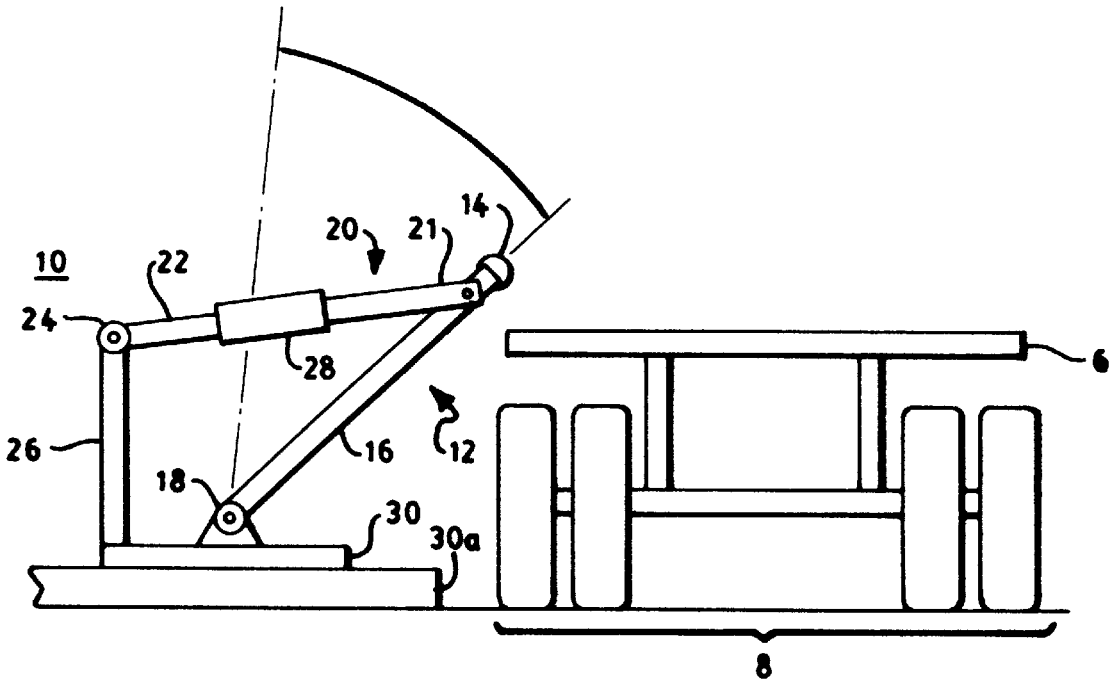
FIG. 2 is another illustration of the exemplary embodiment of FIG. 1 shown in an extended position.

As shown in FIG. 1, an exemplary moveable guard rail system 10 of the present invention comprises a moveable frame structure 12 which comprises at least one guard rail member 14 having a generally elongated body. The guard rail 14 is attached to at least two hinged supportive frame members 16 which are spaced apart from each other. An exemplary guard rail 14 comprises a metal tube or pipe, wooden boards, or other known materials in thickness sufficient to withstand low-speed impacts of fork lift trucks and devices. The hinged supportive frame members 16 are, in turn, connected to axis hinge mounts 18 which operate to permit the frame structure 12 to move from a retracted position, as shown in FIG. 1, to an extended position, as shown in FIG. 2. In an extended position, the guard rail 14 is positioned to prevent fork lift trucks and other loading/unloading devices from falling off the flat bed truck trailer 6 or flat bed railroad car, as the case may be.

The axis hinge mounts 18 fix the moveable frame structure 12 to a base (such as a wooden or brick platform and/or curb) or floor.

Figure 3:
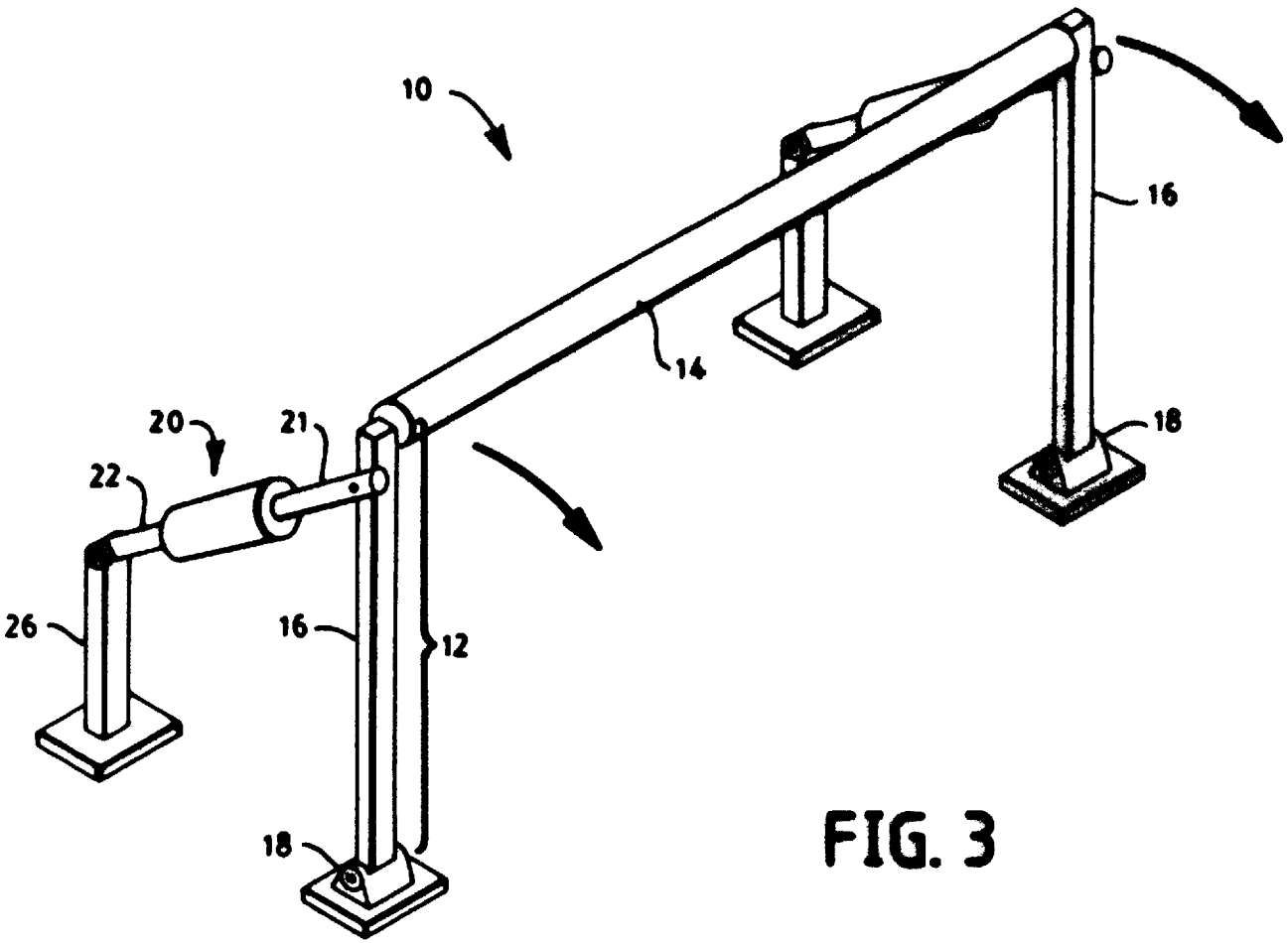
FIG. 3 is a perspective view of an exemplary moveable guard rail system of the present invention.

At least one arm assembly 20 is connected to the moveable frame structure 12. The arm assembly 20 may be connected either directly to a guard rail member 14, to a hinged supportive frame member 16 (as shown in FIGS. 1–3), or, as another example, to a bolt or dowel used for connecting the guard rail 14 and hinged frame member 16 together. The arm assembly 20 comprises at least one generally elongated body having a first arm end 21 and a second arm end 22. The first arm end 21 is attached to the moveable frame structure 12, preferably by bolt, screw, hinge, or bearing to permit relative movement therebetween. The second arm end 22 is hingedly connected to an arm hinge mount 24, which may be connected to a fixed object such as a wall or, as shown in FIGS. 1–3, an elevated hinge mount 26 which could be a wood or steel post, cement block, or other supportive structure.

The arm assembly 20 further comprises means 28 for moving the frame structure 10 from a retracted position (FIG. 1) to an extended position (FIG. 2). Any known means may be employed to actuate the guard rail system 10 between retracted and extended positions, such as a hydraulically operated piston device 28 operable to push the first arm assembly end 21 away from the second arm assembly end 22 and/or to contract so as to shorten the distance between the arm ends 21/22.

Thus, it will be understood that a moveable guard rail system 10 of the present invention can be installed along one or more sides of a flat bed trailer 6, and thus be permanently installed adjacent to a truck (or railroad car) pathway (as designated at 8). Further exemplary guard rail systems 10 comprise one or more mounting platforms 30 and 30*a* (FIGS. 1–2) to provide support for the hinge-mounted frame member 12 and arm member 20 assemblies. The guard rail system 10 may comprise any known materials, such as metal or wood, depending upon the thickness and length of the individual pieces, to provide sufficient strength to the overall structure. Mounting platforms 30 can comprise wood, cement, or other suitable material, and are preferably bolted or cemented to the floor. If the platforms or elevated hinge mounts 26 mounts are not employed, the axis hinge mount 18 and arm hinge mount 24 should preferably be bolted to a floor, curb (e.g., 30A), or wall, as the case may be.

FIG. 3 provides a perspective view of an exemplary guard rail system 10 of the present invention, wherein at least two sets of hinged frame members 16 and arm members 20 are used in spaced apart configuration. A guard rail member 14 of any reasonable length may be used, depending upon the desired application. Preferably, the guard rail member 14 elongated body has a length at least equal to the length of the hinged frame members 16 or arm assembly members 20, and more preferably at least twice the length of either of those members 16/20. It may be preferable, where especially long flat bed trailer trucks are involved, to employ two or more guard rail systems 10, as shown in FIG. 3, on one or both sides of the trailer or rail road car (For simplicity of illustration, a guard rail system 10 is shown on only one side of the trailer 6).

The respective positions of the arm frame member 20 and hinged frame member 16, with respect to the position of the trailer 6, can be altered, such that the arm frame members 20, for example, are located closer to the flat bed trailer 6.

Figure 4:
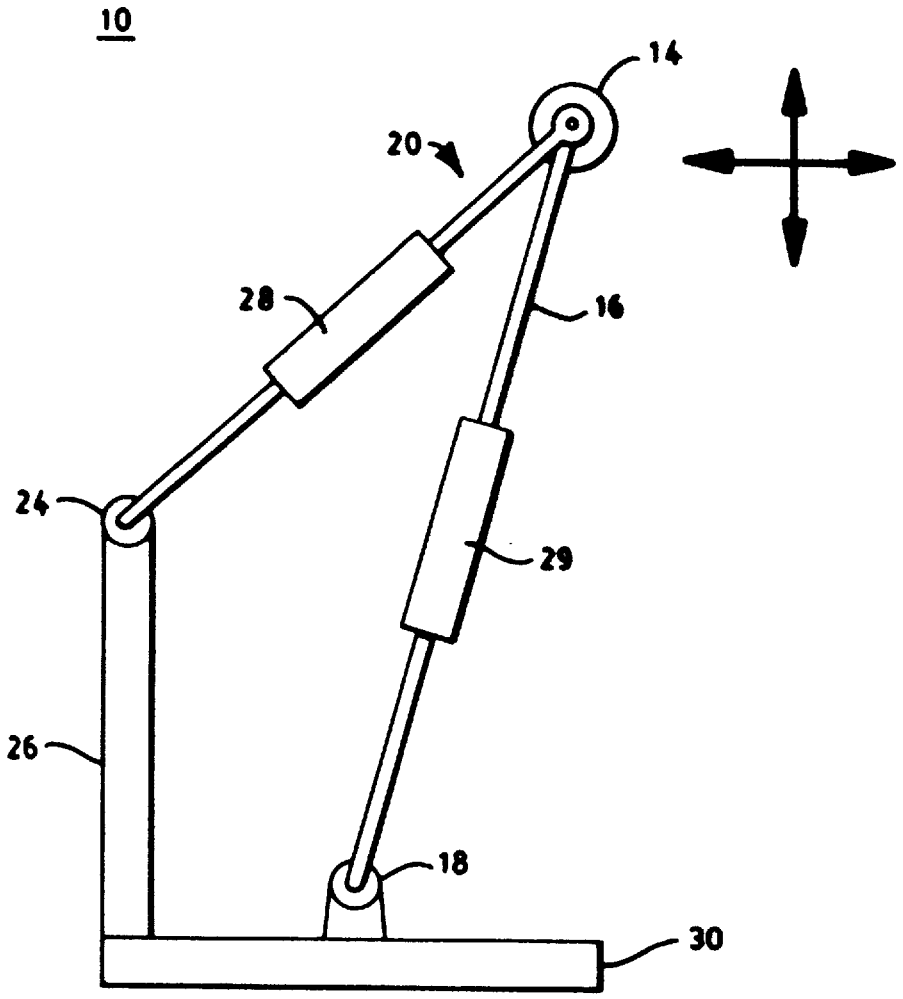
FIG. 4 is an end-view illustration of another exemplary moveable fork lift truck guard rail system of the present invention.

In another examplary embodiment of the invention, the guard rail members 16 may also incorporate hydraulically activated cylinders such that they operate similarly to the previously described arm frame members 20. As shown by the further exemplary embodiment in FIG. 4, the hinged frame members 16 as well as the arm frame members 20 (shown connected directly to the guard rail member 14) each comprise hydraulic cylinders as designated as at 28 and 29. Through these exemplary means the vertical and horizontal position of the guard rail 14 can be adjusted with increased precision.

Figure 5:
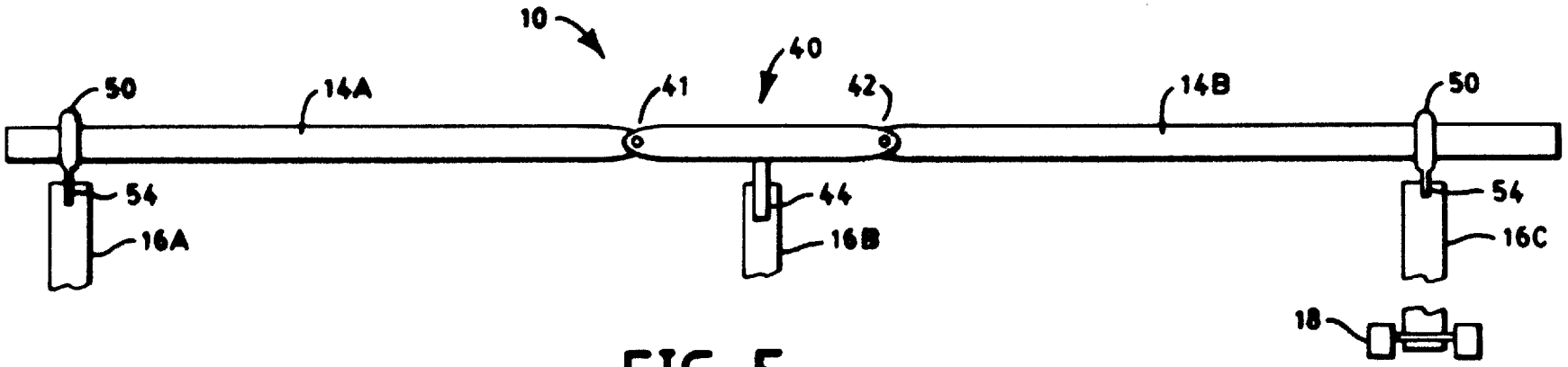
FIG. 5 is a side diagram of another exemplary moveable fork lift truck guard rail system of the invention having at least two sequential guard rails and a plurality of hinged supportive frame members.

FIG. 5 illustrates a further exemplary moveable guard rail system 10 comprising at least two guard rails 14A and 14B which are sequentially (in series) connected to each other, and a plurality (e.g., at least three) supportive frame members 16*a*, 16*b*, and 16*c* which are connected to the guard rails 14A/14B at spaced-apart intervals. Ends of the guard rails 14A/14B are connected to the supportive frame members 16*a* and 16*c*, respectively, by a gimbal bearing 50 operative to permit at least partial rotation of the guard rails (eg., 14*a*) with respect the frame members (e.g., 16*a*). The frame member 16C is partially shown, as is the respective hinge mount 18 to which it is hingedly connected.

Figure 6:
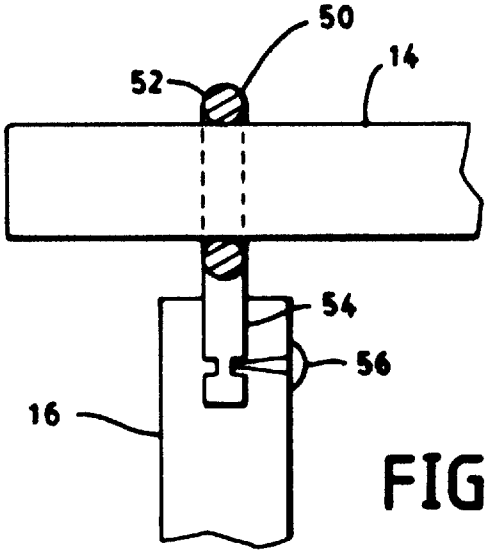
FIG. 6 is an enlarged diagram of an exemplary gimbal bearing for connecting a hinged supportive frame member to a guard rail.

FIG. 6 is an enlarged partial illustration of the exemplary gimbal bearing 50 shown in FIG. 5. The gimbal 50 allows at least partial rotation of the guard rail 14 and supportive frame member 16. For example, a surrounding bearing sleeve 52 surrounds the guard rail 14 (allowing it to rotate, and, in this case, to slide as well) while a tail portion 54 of the gimbal is rotatably mounted in the end of the supportive frame member 16. The tail portion 54 can be rotatably mounted by any means known, such as by a screw 56 which corresponds to a channel or other corresponding shape in the gimbal bearing 50. Preferably, a gimbal bearing 50 is used at both ends of the moveable guard rail system 10. The gimbal bearing 50 permits the guard rail 14A/B to be placed adjacent to the edge of a flat bed trailer which has, for example, backed up against the loading dock at a skewed angle, such that one end of the guard rail system must be moved closer to the trailer in order to present the guard rails 14A and 14B along the skewed edge of the trailer.

The exemplary "T" shaped joint piece shown at 40 in FIG. 5 is preferably connected to each of the guard rails 14A and 14B by hinges, as generally designated at 41 and 42, to permit relative motions of the rails 14A and 14B with respect to each other. The T joint 40 is preferably connected to a supportive frame member 16B in a manner to permit relative rotation about the axis of the frame member 16B. Thus, for example, a tail portion 44 (which can be similar the tail portions 54) can permit different positioning of the guard rails 14A and 14B with respect to, for example, a trailer parked at a skewed angle.

Thus, a further exemplary guard rail system 10 of the invention comprises a moveable frame structure comprising at least two guard rails 14A and 14B connected to each other, preferably by at least one hinge joint; a plurality of hinged supportive frame members 16A, 16B, and 16C; gimbal bearings 50 for connecting said guard rail members to at least two of said frame members and operative to permit at least partial rotation of the guard rails with respect to frame memebers 16A and 16B. A further exemplary guard rail system comprises at least two arm members (such as shown at 20 in FIGS. 1–3) having means for moving the guard rails. If an arm member (20) having such moving means (28) is connected to each of the hinged supportive frame members 16, it is preferable that each of the moving means (whether they comprise hydraulic pistons, screw mechanisms, rack and pinion mechanisms, or the like) are separately controllable so that the various arm members 20, and thus different guard rails 14A/14B or portions thereof, can be maneauverable to accommodate skewed trailers or trucks. For example, hydraulic pistons (28) can be connected by separate switching controls to a pump source so that the extension/retraction of each arm member 20 can be individually controlled.

A preferred guard rail system 10 further comprises a gimbal bearing 50 having a surrounding bearing sleeve 52 to permit slidable engagement of a guard rail member 14A.

The foregoing examples and drawings are provided for illustrative purposes only and are not intended to limit the scope of the invention.

It is claimed:

1. A guard rail system comprising:

a moveable frame structure comprising at least one guard rail member having a generally elongated body;

at least two hinged supportive frame members spaced apart from each other and connected to said guard rail member;

at least two axis hinge mounts spaced apart from each other for hingedly connecting said at least two hinged supportive frame members to a base or floor, whereby said moveable frame structure can be moved between retracted and extended positions;

means for positioning said at least one guard rail member between retracted and extended positions;

and a gimbal bearing member operative to permit at least partial rotation of said at least one guard rail member and one of said hinged supportive frame members with respect to each other, said gimbal bearing member further comprising a bearing sleeve member to permit slidable engagement of said guard rail member with respect to said hinged supportive frame member.

2. The guard rail system of claim 1 wherein said means for positioning said at least one guard rail member is selected from the group consisting of a hydraulic piston, screw device, ratchet mechanism, and rack-and-pinion mechanism.

3. The guard rail system of claim 2 wherein said means for positioning said at least one guard rail member comprises a hydraulic piston.

4. The guard rail system of claim 1 further comprising at least two guard rail members connected sequentially to each other, and further comprising at least three hinged supportive frame members spaced apart from each other.

5. The guard rail system of claim 4 further comprising a T shaped joint connector for connecting said at least two guard rail members and one of said at least three hinged supportive frame members.

6. The guard rail system of claim 4 further comprising at least two gimbal bearing members, each of which is connected to one of said at least two guard rail members connected sequentially to each other.

7. The guard rail system of claim 6 further comprising a T shaped joint connector for sequentially connecting said at least two guard rail members to each other.

8. The guard rail system of claim 7 wherein said T shaped joint connector is further connected to one of said at least three hinged supportive frame members such as to permit relative rotation therewith.

* * * * *